US005224737A

United States Patent [19]

McCurdy et al.

[11] Patent Number: 5,224,737

[45] Date of Patent: Jul. 6, 1993

[54] PROTECTIVE INTEGRAL COVER FOR A BOOK

[75] Inventors: Ralph V. McCurdy, Oak Forest; Ronald V. Mounts, Chicago, both of Ill.

[73] Assignee: Industrial Coatings Group, Inc., Chicago, Ill.

[21] Appl. No.: 770,636

[22] Filed: Oct. 3, 1991

[51] Int. Cl.[5] ..... B42D 3/02

[52] U.S. Cl. ..... 281/29; 281/15.1; 281/51

[58] Field of Search ..... 281/29, 15.1, 51

[56] References Cited

U.S. PATENT DOCUMENTS 3,215,450 11/1965 Peterson et al. ..... 281/29
4,019,758 4/1977 Heller, Jr. et al. ..... 281/29 X
4,294,469 10/1981 Errichiello ..... 281/29

*Primary Examiner*—Paul A. Bell

*Attorney, Agent, or Firm*—Lee, Mann, Smith, McWilliams, Sweeney & Olson

[57] ABSTRACT

An integral cover for a hardback book is disclosed. The book has an edge binding and a pair of stiff side panels, and the cover includes and features a thermoplastic sheet comprising between about 60 to about 85% by weight of a polypropylene homopolymer, between about 12 and about 32% by weight calcium carbonate, and between about 3 to about 12% by weight of a low density polyethylene carrier for the calcium carbonate. The edges of the thermoplastic sheet are turned over the edges of the stiff side panels of the book and adhesively secured thereto and smooth, wrinkle-free gutters are formed in the thermoplastic sheet between the edge binding of the book and each of the stiff side panels to provide hinges for the covered side panels. The cover is a substitute for book covers made of cloth, paper or vinyl and the formulation permits the sheet material to be easily cut, smoothly formed in the gutters and reduces the tendency of blocking and of sticking to the hot lettering stamp.

10 Claims, 1 Drawing Sheet

PROTECTIVE INTEGRAL COVER FOR A BOOK

BACKGROUND OF THE INVENTION

This invention relates to a protective integral cover for a hard cover book and to a new and improved method for covering hard cover books.

Heretofore, hard cover books have been covered either in leather, cloth, paper or vinyl because only these materials can be readily formed and stamped in a way that would provide a quality cover for the book. In mass produced hard cover books, only cloth, paper and vinyl have been economically feasible. It has not heretofore been possible to use polypropylene as a book covering material because polypropylene sheets do not cut well, and do not form well in the gutters, i.e. the grooved hinges between the edge binding and the stiff side panels of the book cover. It is essential in a quality book cover that all edges be sharp and clean, that all portions of the cover be free from wrinkles, and that the gutters be completely smooth, but not shiny and it must be free of bubbles and heat distortion. A wrinkled, shiny or bubbly gutter detracts from the appearance of the book and is unacceptable. Moreover polypropylene tends to stick to the hot lettering stamp used to impress letters into the cover of the book, and polypropylene sheets tend to block or stick together so that when stacked they cannot be readily separated into individual sheets without some effort. Thus polypropylene simply did not measure up to a quality book cover material. Nevertheless the desirability of polypropylene from the environmental standpoint is great.

It has been found that if a polypropylene homopolymer is properly mixed with a proper amount and type of calcium carbonate and extruded, the resultant blended film (1) can be easily cut, (2) will form well in the gutters, (3) will have very little tendency to stick to the hot lettering stamp, and (4) the blocking problem can be minimized.

SUMMARY OF THE INVENTION

In accordance with this invention, a protective integral cover is provided for a hard cover book having an edge binding and a pair of stiff side panels. The cover includes a thermoplastic non-woven sheet comprising between about 60 to about 85% by weight of a polypropylene homopolymer, between about 12 to about 32% by weight calcium carbonate and between about 3 to about 12% by weight of a polyolefin carrier, preferably a linear low density polyethylene. The carrier is present in an amount of at least 25%, and preferably between about 40 and 45% of the weight of the calcium carbonate. Thus, if approximately 12% of the cover is calcium carbonate, at least 3% of the cover should be the polyolefin (preferably polyethylene) carrier. The edges of the sheet are turned over the edges of the stiff side panels of the book and are adhesively secured to the underside of the panels. A smooth wrinkle-free gutter is hot pressed in the sheet at the junctures between the edge binding of said book and each of the stiff side panels of the book thereby providing a hinge for each of the covered stiff side panels of the book.

The sheet is preferably extruded and is between 3 and 12 mils in thickness. The extrusion process may use the case embossed process with a wet nip engraved roll.

The invention also consists of the process for producing a protective cover for a book which process comprises the steps of extruding a thin sheet comprising between about 60 to about 85% by weight polypropylene and between about 15 to about 40% by weight calcium carbonate in a polyolefin carrier, cutting the sheet to size, turning the edges of the sheet over the edges of the stiff side panels and adhesively securing them to the underside of the panel, and forming under heat and pressure a wrinkle-free gutter in the sheet at the junctures between the edge binding of the book and each of the side panels to provide a hinge for each of the covered side panels.

DETAILED DESCRIPTION OF THE PREFERRED EMBODIMENTS

Figure 1:
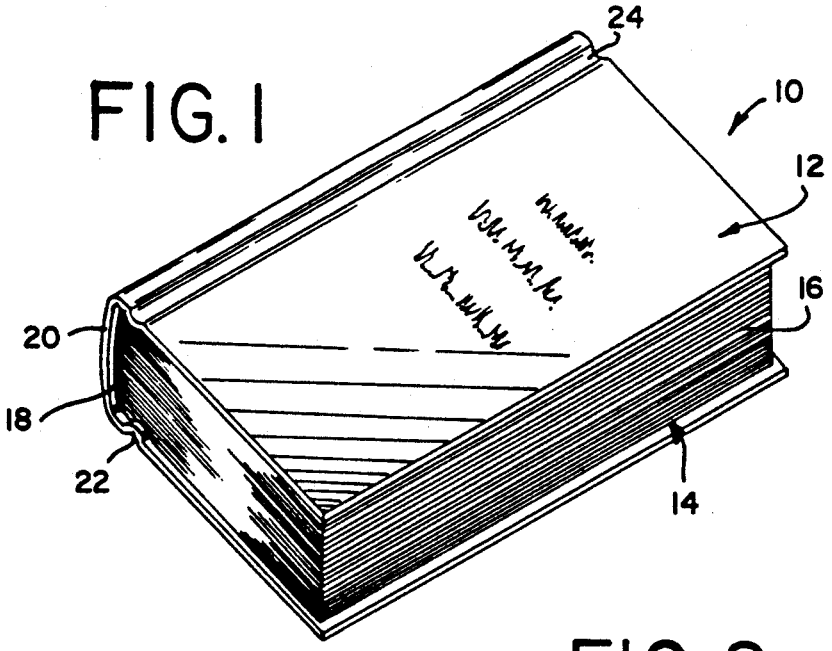
FIG. 1 is a perspective view of a book having a cover constructed in accordance with the present invention and showing the gutters at the junctures between the side panels of the book and the edge binding of the book.

In FIG. 1 there is illustrated a hard covered book 10 having a top cover 12, a bottom cover 14 and a number of pages 16 which are secured together at their inside edges by means of an edge binding 18. Integral with and connecting the top cover 12 and the bottom cover 14 is an end panel or spine 20, the connection being through a pair of gutters 22 and 24 which form the hinges for the top and bottom covers 12 and 14.

Figure 3:
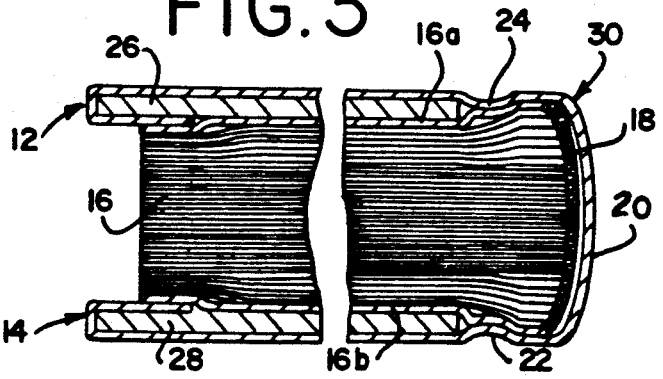
FIG. 3 is a sectional view taken substantially along line 3—3 of FIG. 1.

In FIG. 3 the details of this construction are illustrated in more detail. The book pages 16, which are connected at their inner edges by the edge binding 18, include a pair of end pages **16*a* and 16*b* which are preferably thicker and stronger than the other pages. The cover for the book consists of a stiff panel 26 for the top cover 12 and another stiff panel 28 for the bottom cover 14. The stiff cover panels 26 and 28 are preferably formed of cardboard, although they could be formed of any composition of stiffening material. The top end page 16*a* is adhesively secured to the top stiff panel 26 and in like manner, the bottom end page 16*b* is adhesively secured to the bottom stiff panel 28**.

The selection of the outer covering material 30 is most important because the cover of the book must project a high quality and finished appearance. The cover material 30 must be capable of being cut well, forming smooth but non-shiny, bubble-free and wrinkle-free gutters 22 and 24 and it must be capable of being hot-letter stamped without sticking to the hot lettering die. In addition, the pre-cut and stacked sheets of cover material must be capable of being readily and individually separated from the other sheets, because if the sheets tend to stick together, the process of covering the book will be continually interrupted and cannot be satisfactorily automated.

For many years books have been covered with linen and other fine cloths, and of course leather has been used as a cover material for high quality books for many years. More recently, vinyl and paper have come into use as book covering materials. However, vinyl has an environmental problem in that it does not decompose in landfills and incineration releases toxic fumes. Thus for some time there has been a search for a quality synthetic material which will replace cloth and paper book covering material but will not have the disadvantages of vinyl. Prior to this invention, book covers could not be satisfactorily produced using polypropylene.

The material 30 for covering the book in accordance with the present invention is a particular polypropylene having a quantity of calcium carbonate mixed into it in such a way that the film will extrude well, cut well, will not stick to the hot lettering stamp, and will form smooth wrinkle-free, bubble-free, distortion-free and non-shiny gutters. In short, it works very well as a book cover. This material is a blend of a polypropylene homopolymer, particulate calcium carbonate and a polyolefin carrier, which polyolefin is other than polypropylene and is preferably a linear low density polyethylene. The preferred carrier for the calcium carbonate is a linear low density polyethylene having a melt index of about 20 and a density of about 0.924. One such material that has been found satisfactory is sold under the trademark NOVAPOL GI-2024A by Nova Corporation of Alberta.

The polypropylene homopolymer is present in the range of between about 60 and about 85% and the calcium carbonate and carrier are present in an amount of between about 15% and about 40% with the carrier being at least 25% (and preferably between about 40 and 45%) of the weight of the calcium carbonate. The calcium carbonate and polyethylene carrier are introduced in the form of pellets which are mixed for about 15 minutes with pellets of the polypropylene homopolymer in, for example, a 3000 pound Brower mixer. This pellet mixture is then transferred to a 4½ inch 24:1 extruder in which the mixture is heated and the constituents are blended together being brought up to an extruding temperature of about 520° F. The molten blend is then cast in a 3 to 12 mil sheet (preferably about 4½ mil). One polypropylene which has been found quite acceptable is sold under the trademark PRO-FAX PD-064 by Himont U.S.A. This has a melt index (melt flow rate, dg/min—ASTM D-1238) of 4, a density of 0.903 g/cm$^3$ (ASTM D-792A-2) and a hardness of 99 on the Rockwell R scale.

In this process known as the "cast embossed process" the molten blend exits the extruder in a sheet form out of a flat die and is cast onto a steel engraved roll. In order to cool and complete the finish for the material there is provided a wet nip at the engraved roll in which a rubber back-up roller rotates in a water pan and forms a poll of water before the nip. This puts a bright shiny finish to the underside of the film while the engraved roll puts a matte, sand, linen, or other desired finish on the top side of the film.

The following are examples of various mixtures and blends which have been extruded:

EXAMPLE I 85 pounds of the PRO-FAX PD-064 polypropylene homopolymer (melt index of 4) was mixed with 15 pounds of a pelletized mixture of $CaCO_3$ and a linear low density polyethylene carrier. The carrier comprised 20% by weight of the total weight of the pelletized mixture, or in other words, an 80% loading of $CaCO_3$. Thus the mixture contained by weight 85% polypropylene, 17% $CaCO_3$ and 3% linear low density polyethylene carrier. To this was added 6 pounds of a black color concentrate in pellet form. These materials were mixed in a Brower mixer and then transferred to 24:1 screw extruder where the mixture was heated to 520° F. and extruded through a slot die to form a sheet 4½ mils in thickness which was cast onto a steel engraved roll having a wet nip.

The resultant sheet was cut and stacked and the stacked sheets were used to cover books and were heat formed and imprinted. Each sheet was easily separated from the other sheets in the stack, cut well, exhibited no undue heat distortion, formed the gutters without wrinkles, bubbles or shine, and imprinted without sticking to the hot lettering die.

EXAMPLE II 80 pounds of the polypropylene homopolymer and 20 pounds of the pelletized $CaCO_3$ and linear low density polyethylene carrier (80% loading) were mixed with 6 pounds of black concentrate and extruded as in Example I. Thus the mixture prior to the addition of color concentrate contained 80% polypropylene, 16% $CaCO_3$ and 4% polyethylene. The sheets cut well, were easily separated from each other in the stack, formed well under heat and pressure, and exhibited no problems in forming the gutters or in hot stamping of letters on the cover.

EXAMPLE III 75 pounds of the polypropylene homopolymer and 25 pounds of pelletized $CaCO_3$ and linear low density polyethylene carrier (80% loading) were mixed with 6 pounds of black concentrate and extruded as in Example I. Thus the mixture prior to the addition of color concentrate contained 75% polypropylene 16% $CaCO_3$ and 14% polyethylene. The sheets cut well, were easily separated from each other in the stack, formed well under heat and pressure, and exhibited no problems in forming gutters or in hot stamping of letters on the cover.

EXAMPLE IV 60 pounds of the polypropylene homopolymer and 40 pounds of pelletized $CaCO_3$ and polyethylene carrier (80% loading) were mixed with 6 pounds of black concentrate and extruded as in Example I. Thus the mixture prior to the addition of color concentrate contained 60% polypropylene, 32% $CaCO_3$ and 8% polyethylene. Again the sheets cut well, were easily separated from each other in the stack, formed well under heat and pressure, and exhibited no problems in forming smooth gutters or in the hot stamping of letters on the cover.

While the foregoing examples worked perfectly well on a small scale, it was found difficult to achieve repeating acceptable results on a large scale with an 80% loading of $CaCO_3$. For this reason a 70% loading was tried and found quite acceptable and repeatable. That formulation is thus preferred. The $CaCO_3$ had a median particle size of 3.9 microns (with 0.005% retained in a #325 wet screen) and contained about 1% of a processing aid or lubricant, such as calcium stearate. The preferred linear low density polyethylene has a melt index of 20 and a density of 0.924. One such polyethylene is sold by Nova Chemical Plastic Division of Alberta under the trademark NOVAPOL GI-2024-A. It is also preferred that there by approximately 3% of a conventional antistat additive to reduce static and minimize dirt buildup on the extruded film. The following examples show the use of a 70% loading of $CaCO_3$.

EXAMPLE V 80 pounds of PROFAX PDO 64 polypropylene homopolymer (melt index of 4) was mixed with 20 pounds of a pelletized mixture of $CaCO_3$ containing NOVAPOL GI-2024-A linear low density polyethylene as a carrier. The carrier comprised 30% by weight of the total weight of the pelletized mixture, or in other words a 70% loading of $CaCO_3$. Thus, the mixture contained by weight 80% polypropylene, 14% $CaCO_3$ and 6% linear low density polyethylene carrier. To this was added 3 pounds of A-21750 Natural Antistat Polyethylene Additive Concentrate manufactured by Polycom Huntsman, Inc. and 6 pounds of a black concentrate in pellet form. These materials were mixed in a Brower mixer and then transferred to a 24:1 screw extruder where the mixture was heated to 520° and extruded through a slot die to form a sheet 4½ mils in thickness which was cast on to a steel engraved roll having a wet nip.

The resultant sheet was cut and stacked and the stacked sheets were used to cover books and were heat formed and imprinted. Each sheet was easily separated from the other sheets in the stack, cut well, exhibited no undo heat distortion and imprinted without sticking to the hot lettering dye.

EXAMPLE VI 60 pounds of the polypropylene homopolymer and 40 pounds of the pelletized $CaCO_3$ and linear low density polyethylene carrier (70% loading) were mixed with 3 pounds of an antistat and 6 pounds of black concentrate and extruded as in Example V. Thus, the mixture prior to the addition of the color concentrate contained 60% polypropylene, 28% calcium carbonate and 12% linear low density polyethylene. The sheets cut well and were easily separated from each other in the stack, formed well under heat and pressure, exhibited no undo heat distortion and formed very well in the gutters without melting, wrinkles bubbles or shine, and imprinted without sticking to the hot lettering die. This particular formulation was believed to be superior in the forming of the gutters without wrinkles, bubbles, shine or melting to the formulation set forth in Example V.

From the foregoing examples it may be seen that a quality book cover can be produced using by weight between about 60 to about 85% polypropylene homopolymer, between about 12% and about 32% calcium carbonate and between about 3 to about 12% low density polyethylene.

If the amount of calcium carbonate is less than about 12% the polypropylene won't cut properly and will not have proper heat resistance which causes heat distortion, wrinkles or bubbles in the gutters and sticking to the hot lettering die. In fact for proper formation of gutters the book cover material should contain about 60% polypropylene, about 28% $CaCO_3$ and about 12% linear low density polyethylene. If the calcium carbonate is more than about 32% the blend will not always extrude properly.

Figure 2:
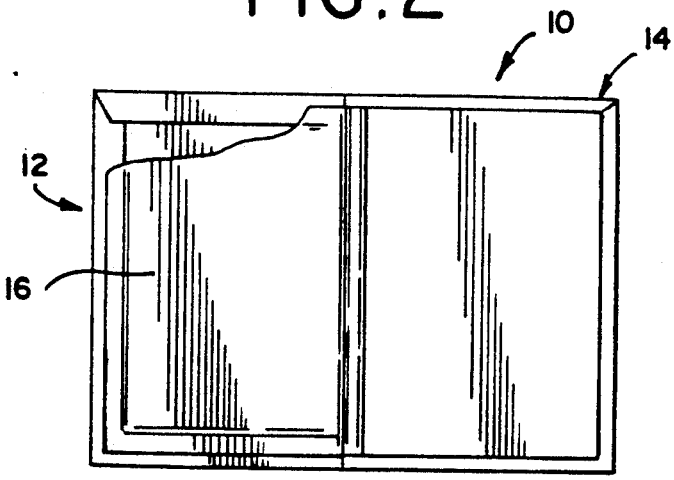
FIG. 2 is a top plan view of the book with the front cover opened and a portion of the page broken away to show the stiff side panel and the attachment of the cover sheet.
Figure 4:
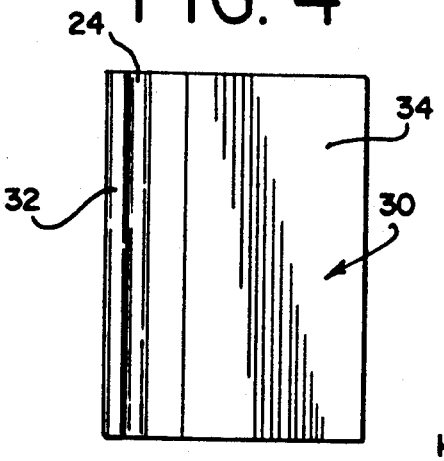
FIG. 4 is a top plan view of a book incorporating a slightly modified embodiment of the invention wherein the cover is formed in three separate pieces, two side panels, and an end panel adhesively secured together.

In FIGS. 1–3 the outer covering material 30 is a single sheet covering the binding 18, encompassing the gutters 22 and 24, and covering the entire outer surfaces of both stiff panels 26 and 28. In the modified embodiment of FIG. 4 the outer material is in three pieces. The end piece or spine 32 covers the binding 18 and encompasses the gutters 22' and 24' (only gutter 24 is shown) and extends part way over the stiff panels, thereby connecting the spine 32 and the stiff panels. The other two pieces are side pieces 34 (only one is shown in FIG. 4) which cover the remainder of the stiff panels 26 and 28. While all three pieces of the outer covering material may be the same, frequently these materials are different. They may be of different texture, different colors or totally different materials.

The foregoing detailed description has been given only by way of example, and it will be appreciated by those skilled in the art that there may be modifications made without departing from the scope of the invention as defined in the appended claims.

What is claimed is:

1. A protective cover for a book having an edge binding, said cover including a pair of stiff side panel portions, a spine portion and a thermoplastic sheet connecting all three portions together, said sheet comprising between about 60 to about 85% by weight polypropylene homopolymer, between about 12 to about 32% by weight calcium carbonate, and between about 3 to about 12% by weight of a polyolefin carrier, the polyolefin being other than a polypropylene.

2. The structure of claim 1 wherein said sheet is extruded.

3. The structure of claim 2 wherein said sheet is extruded using cast embossed process with a wet nip engraved roll.

4. The structure of claim 1 wherein said sheet is 3–12 mils in thickness.

5. The structure of claim 1 wherein the carrier is a linear low density polyethylene having a melt index of about 20 and is present in an amount by weight of at least 25% of the calcium carbonate, the edges of said sheet being turned over the edges of said stiff side panels and adhesively secured to the under side thereof, and smooth wrinkle-free gutters being formed in said sheet immediately adjacent the edge binding of said book and each of said stiff side panels to provide a hinge for each of said covered stiff side panels.

6. The structure of claim 5 wherein the linear low density polyethylene carrier is present in an amount of between about 40% land about 45% of the weight of the calcium carbonate.

7. The structure of claim 1 wherein said spine portion is integral with and of the same material as the thermoplastic sheet.

8. In combination with a book having an edge binding, a protective cover including a pair of stiff side panel portions, a spine portion and a thermoplastic sheet overlying at least a portion of said side panel portions and connecting the three portions together, said sheet comprising between about 60 to about 85% by weight polypropylene homopolymer, between about 12 to about 32% by weight calcium carbonate, and between about 3 to about 12% by weight of linear low density polyolefin carrier.

9. The structure of claim 8 wherein said cover sheet has its edges turned over the edges of said stiff side panel portions and adhesively secured to the underside thereof, and said thermoplastic sheet overlies the edge binding and gutter hinges are formed in said cover sheet between the side panels and the edge binding.

10. The structure of claim 9 wherein said gutter hinges are formed in said thermoplastic sheet under heat and pressure.

* * * * *